US006736935B2

(12) United States Patent
Hermans et al.

(10) Patent No.: US 6,736,935 B2
(45) Date of Patent: May 18, 2004

(54) DRYING PROCESS HAVING A PROFILE LEVELING INTERMEDIATE AND FINAL DRYING STAGES

(75) Inventors: Michael Alan Hermans, Neenah, WI (US); Charlcie Christie Kay Leitner, Appleton, WI (US); Michael Joseph Garvey, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/185,774

(22) Filed: Jun. 27, 2002

(65) Prior Publication Data

US 2004/0003906 A1 Jan. 8, 2004

(51) Int. Cl.[7] ..... D21F 5/02; D21F 5/16; D21F 5/18; D21F 11/00

(52) U.S. Cl. ..... 162/109; 162/121; 162/192; 162/207; 162/DIG. 6

(58) Field of Search ..... 162/109–117, 204, 162/206, 207, 290, 121, 359.1, 135, 192, DIG. 6; 34/108–127, 414, 419–422, 423–425, 444, 618, 623, 624, 629; 428/152–3, 198

(56) References Cited

U.S. PATENT DOCUMENTS

| | | | | |
|---|---|---|---|---|
| 2,001,023 A | * | 5/1935 | Howell et al. | 162/111 |
| 3,052,991 A | | 9/1962 | Goldner | |
| 3,089,252 A | | 5/1963 | Danne et al. | |
| 3,161,482 A | | 12/1964 | Gschwind et al. | |
| 3,214,845 A | | 11/1965 | Huffman | |
| 3,284,920 A | | 11/1966 | Hayrinen et al. | |
| 3,292,274 A | | 12/1966 | Seth | |
| 3,293,770 A | | 12/1966 | Rauskolb | |
| 3,434,918 A | * | 3/1969 | Bernardin | 162/111 |
| 3,678,594 A | | 7/1972 | Goerz, Jr. et al. | |
| 3,791,044 A | | 2/1974 | Busker et al. | |
| 3,791,049 A | | 2/1974 | Smith, Jr. et al. | |
| 3,793,741 A | | 2/1974 | Smith, Jr. et al. | |
| 3,798,784 A | | 3/1974 | Kovats et al. | |
| 3,806,406 A | * | 4/1974 | Ely | 162/206 |
| RE28,459 E | * | 7/1975 | Cole et al. | 34/306 |
| 4,157,938 A | | 6/1979 | Clemens et al. | |
| 4,191,609 A | | 3/1980 | Trokham | |
| 4,300,981 A | | 11/1981 | Carstens | |
| 4,309,246 A | * | 1/1982 | Hulit et al. | 162/113 |

(List continued on next page.)

FOREIGN PATENT DOCUMENTS

| | | | |
|---|---|---|---|
| EP | 3445615 | A1 | 6/1986 |
| EP | 0 728 285 | B1 | 10/1997 |
| EP | 0 989 231 | A2 | 3/2000 |
| JP | 06-294091 | A | 10/1994 |
| WO | WO 92/12291 | A1 | 7/1992 |
| WO | WO 99/32714 | A1 | 7/1999 |
| WO | WO 00/34572 | A1 | 6/2000 |
| WO | WO 00/38749 | A1 | 7/2000 |
| WO | WO 01/00925 | A1 | 1/2001 |

*Primary Examiner*—Peter Chin
*Assistant Examiner*—Eric Hug
(74) *Attorney, Agent, or Firm*—Patricia A. Charlier; Gregory E. Croft

(57) ABSTRACT

The energy efficiency of a primary drying papermaking process is improved by the use of auxiliary dryers to dry the wet tissue webs to a final moisture of about 5% or less and adjust the CD moisture profiles of the wet and partially-dried tissue webs.

95 Claims, 6 Drawing Sheets

U.S. PATENT DOCUMENTS 4,443,185 A 4/1984 Smith
4,498,864 A 2/1985 Roth et al.
4,529,480 A 7/1985 Trokhan
4,556,450 A 12/1985 Chuang et al.
4,590,685 A 5/1986 Roth
4,808,266 A 2/1989 Faurie
5,048,589 A 9/1991 Cook et al.
5,126,015 A 6/1992 Pounder
5,137,600 A 8/1992 Barnes et al.
5,152,076 A 10/1992 Virta et al.
5,261,166 A 11/1993 Seeley et al.
5,306,395 A * 4/1994 Myren ..... 162/301
5,336,373 A * 8/1994 Scattolino et al. ..... 162/116
5,377,428 A 1/1995 Clark
5,389,202 A 2/1995 Everhart et al.
5,399,412 A 3/1995 Sudall et al.
5,494,554 A 2/1996 Edwards et al.
5,607,551 A 3/1997 Farrington, Jr. et al.
5,614,293 A 3/1997 Krzysik et al.
5,616,207 A 4/1997 Sudall et al.
5,630,285 A 5/1997 Kerttula et al.
5,656,132 A 8/1997 Farrington, Jr. et al.
5,667,636 A 9/1997 Engel et al.
5,672,248 A 9/1997 Wendt et al.
5,672,306 A 9/1997 Sprang et al.
5,746,887 A 5/1998 Wendt et al.
5,749,164 A 5/1998 Bowden
5,772,845 A 6/1998 Farrington, Jr. et al.
5,830,321 A 11/1998 Lindsay et al.
5,851,353 A * 12/1998 Fiscus et al. ..... 162/113
5,862,613 A 1/1999 Kerttula et al.
5,865,824 A 2/1999 Chen et al.
5,888,347 A 3/1999 Engel et al.
5,932,068 A 8/1999 Farrington, Jr. et al.
5,935,383 A 8/1999 Sun et al.
6,017,417 A 1/2000 Wendt et al.
6,080,279 A 6/2000 Hada et al.
6,083,346 A 7/2000 Hermans et al.
6,096,169 A 8/2000 Hermans et al.
6,143,135 A 11/2000 Hada et al.
6,149,767 A 11/2000 Hermans et al.
6,171,442 B1 1/2001 Farrington, Jr. et al.
6,183,601 B1 2/2001 Otto et al.
6,187,137 B1 2/2001 Druecke et al.
6,197,154 B1 3/2001 Chen et al.
6,228,220 B1 5/2001 Hada et al.
6,231,719 B1 5/2001 Garvey et al.
6,264,792 B1 7/2001 Kuosa et al.
6,440,273 B1 * 8/2002 Jewitt ..... 162/290
6,488,816 B1 * 12/2002 Klerelid ..... 162/359.1
6,527,913 B1 * 3/2003 Johnson et al. ..... 162/111
6,558,510 B1 * 5/2003 Edwards et al. ..... 162/111

* cited by examiner

DRYING PROCESS HAVING A PROFILE LEVELING INTERMEDIATE AND FINAL DRYING STAGES

BACKGROUND

In the manufacture of tissue-based products such as facial and bath tissue, paper towels, and napkins, the wet tissue web is commonly dewatered and then dried on one or more through-air-dryers (TADs.) A TAD is an open-deck cylinder that supports a throughdrying fabric, which in turn supports the wet tissue web being made. This method employs passing heated air from a hood, through the wet tissue web and fabric, and into the open TAD. The hot air is cooled as it moves through the wet tissue web and picks up moisture. Some of the air is exhausted to decrease the moisture build-up within the TAD system and the remainder of the air is then recycled to a burner where fresh makeup air may be introduced. The air is then reheated and returned through the wet web to the TAD to complete the cycle.

The throughdrying technique is advantageous in that it allows high-bulk sheets to be made by molding the paper web onto a highly topographic fabric as it is passed over the TADs. Because the motive force used to mold and dry the web is hot, relatively dry air, the capital and energy costs of a TAD system can be quite expensive in comparison to the costs for a standard wet-pressed tissue machine. During the drying process in general, and throughdrying in particular, the energy efficiency is high in the initial stages of drying, but tends to become progressively lower as water is removed from the tissue web. Generally, this reduced efficiency must be accepted when drying is being carried out in the falling-rate drying zone where mass-transfer-limited drying becomes dominant.

In general, the final moisture content of a tissue web, and paper universally, is roughly 5%. Expressed in terms of consistency, the final, or reel, basesheet consistency is about 95%. This final moisture content is roughly the equilibrium moisture content of tissue or paper exposed to air. Thus, the tissue web or paper at ambient humidity will contain roughly 5% moisture, though most would consider it to be "dry." Hence there is little incentive for the tissue maker to dry the tissue web to less than 5% final moisture content as the tissue web will re-absorb moisture from the ambient air and re-equilibrate at the 5% moisture content level.

Given the high cost of drying in the low moisture regime, the tissue manufacturer strives to manufacture product at the highest possible final moisture. Although the additional amount of water removed is very small, drying a tissue web to about 3% moisture may require an additional 10% more energy than drying a tissue web to about 5% moisture. For example, in a standard throughdried tissue-making process where the wet tissue web enters the throughdryers at about 33% consistency (about 2 pounds of water per pound of fiber), the additional water removal from the 5% moisture content to the 3% moisture content (only 0.02 pounds of water per pound of fiber) represents about 1% of the total drying load. It is not surprising the tissue maker is reluctant to spend approximately 10% more energy to remove only 1% more water, especially when this is normally not required to improve product quality.

The only incentive for additional water removal would be if the improvement in product properties associated with the additional water removal would exceed the cost of the additional drying. However, in most paper processes, adequate properties can be achieved at a final moisture content level of 5%. Any additional drying would not add value, and hence is avoided.

However, in some tissue making processes, especially those where the creping step has been eliminated, as in uncreped through-air dried (UCTAD) technology, the final tissue web moisture content is a major determinant of the product properties, and in these cases, it is necessary to have a very low moisture content at the reel of the tissue machine. For example, the uncreped throughdried tissue process described in U.S. Pat. No. 5,607,551 issued on Sep. 30, 1997 to Farrington et al. requires that the moisture content of the tissue web be reduced to approximately 1% moisture in order to maximize sheet softness. In this and other related processes, it is imperative that the final sheet moisture be as low as possible in order to maintain the softness of the tissue web through any calendering operations. Hence, in such processes, it is highly desirable to develop an efficient drying process for drying in the very low moisture regime of about 5% moisture to about 1% moisture.

Similarly, for wet-pressed tissue, improved product properties can be achieved by drying the sheet to very low moistures followed by creping. Final moistures may be as low as 1% to 3%. Again, a high-efficiency drying process for moistures below 5% is highly desirable.

To explain more fully the mechanism of drying paper or tissue, an understanding of the states of water in cellulosic webs is useful. In cellulosic fibers, three forms of water are present. Bulk water is present within the fiber cell in macropores, the areas that remain when lignin and hemicellulose are removed during the pulping process. Freezing bound water is present in the amorphous areas of the fiber's lamellae. The final category of water is non-freezing bound water, which is adsorbed onto hydrophilic groups in the cell wall, such as hydroxyl groups. As moisture is removed and the wet tissue web is dried, two significant moisture transitions are crossed. At a moisture ratio of between about 0.5 to about 0.8 pound water per pound fiber, all of the bulk water has been removed from the fiber cell, mostly by mechanical means, and all remaining water is present in the form of freezing or nonfreezing bound water. Beginning at a moisture ratio of about 0.25 pounds water per pound fiber, the pores of the fiber collapse and only non-freezing water that is bound to the hydroxyl groups remains. This water requires high amounts of energy to remove. It is in this region that an auxiliary drying method becomes most important. Such auxiliary drying may be accomplished using infrared dryers, microwave dryers, radio frequency dryers, sonic dryers, dielectric dryers, ultraviolet dryers, and combinations thereof.

SUMMARY OF THE INVENTION

It has been unexpectedly discovered that drying the tissue web with an auxiliary dryer from about 5% to about 1% moisture requires an order of magnitude less energy per pound of water removed from the tissue web vs. a drying process using only conventional means (primary dryers), such as a TAD system, a Yankee dryer system, or Yankee dryer/hood combination system. The primary dryer could also be a condebelt apparatus or high-intensity nip press dryer. The efficiency of the auxiliary drying in the low moisture regime is especially apparent when evaluated against current practices. For example, compared to a 50,000 BTU per pound water requirement by both a commercial and a pilot throughdryer system to dry a tissue web from about 0.03 to about 0.01 pounds of water per pound of fiber moisture content range, the auxiliary dryer, such as a microwave dryer, required only about 4,000 to about 8,000 BTU per pound water removed. This increase in drying efficiency can translate to a machine speed increase during the drying process to achieve a given level of dryness or an increased level of dryness at current machine speeds or even an energy savings at constant level of dryness and machine speed. It would be particularly advantageous to situate an auxiliary dryer after the last primary dryer, such as a throughdryer, to remove the last few percent moisture in the tissue web. This would allow the primary dryers, like throughdryers, to operate at a lower temperature or load because of the increased final level of moisture in the tissue web required as the tissue web exits the primary dryer and enters the auxiliary dryer.

Hence, in one aspect, the present invention resides in a process for making tissue comprising: (a) forming the wet tissue web by depositing an aqueous suspension of papermaking fibers onto a forming fabric; (b) partially dewatering the wet tissue web; (c) partially drying the wet tissue web in at least one primary dryer; (d) additionally drying the wet tissue web further by passing the wet tissue web through an auxiliary dryer, wherein the auxiliary dryer dries the wet tissue web to a final moisture content of about 5% or less, thereby forming a dried tissue web; and (e) winding the dried tissue web into a parent roll.

In another aspect, the present invention resides in a process for making tissue comprising: (a) forming the wet tissue web by depositing an aqueous suspension of papermaking fibers onto a forming fabric; (b) partially dewatering the wet tissue web; (c) partially drying the wet tissue web in at least one throughdryer; (d) additionally drying the wet tissue web further by passing the wet tissue web through an auxiliary dryer, wherein the auxiliary dryer dries the wet tissue web to a final moisture content of about 5% or less, thereby forming a dried tissue web; and (e) winding the dried tissue web into a parent roll.

In another aspect of the present invention, an auxiliary dryer is placed between two primary dryers, thereby adjusting the moisture profile of the wet tissue web prior to final drying. As discussed below, the moisture content of the wet tissue web is not evenly distributed throughout the web, causing preferential and inefficient drying of the wet tissue web. Use of the auxiliary dryer can provide a more uniform moisture profile by preferentially drying the wet areas of the tissue web, thereby allowing for more efficient drying as the wet tissue web is passed over the following primary dryer. In addition, less drying may be required if the areas of the wet tissue web having higher than average moisture were preferentially dried, providing a more uniform moisture profile of the wet tissue web, thereby allowing for more efficient drying as the wet tissue web is passed over the following primary dryer.

According to another aspect of the present invention, an auxiliary dryer is placed between two throughdryers, thereby adjusting the moisture profile of the wet tissue web prior to final drying. As discussed below, the moisture content of the wet tissue web is not evenly distributed throughout the web, causing preferential and inefficient drying of the wet tissue web. Use of the auxiliary dryer can provide a more uniform moisture profile by preferentially drying the wet areas of the tissue web, thereby allowing for more efficient drying as the wet tissue web is passed over the following throughdryer. In addition, less drying may be required if the areas of the wet tissue web having higher than average moisture were preferentially dried, providing a more uniform moisture profile of the wet tissue web, thereby allowing for more efficient drying as the wet tissue web is passed over the following throughdryer.

Other aspects of the present invention will be apparent in view of the following description of the preferred embodiments and the accompanying drawings.

DETAILED DESCRIPTION OF THE DRAWINGS

Figure 1:
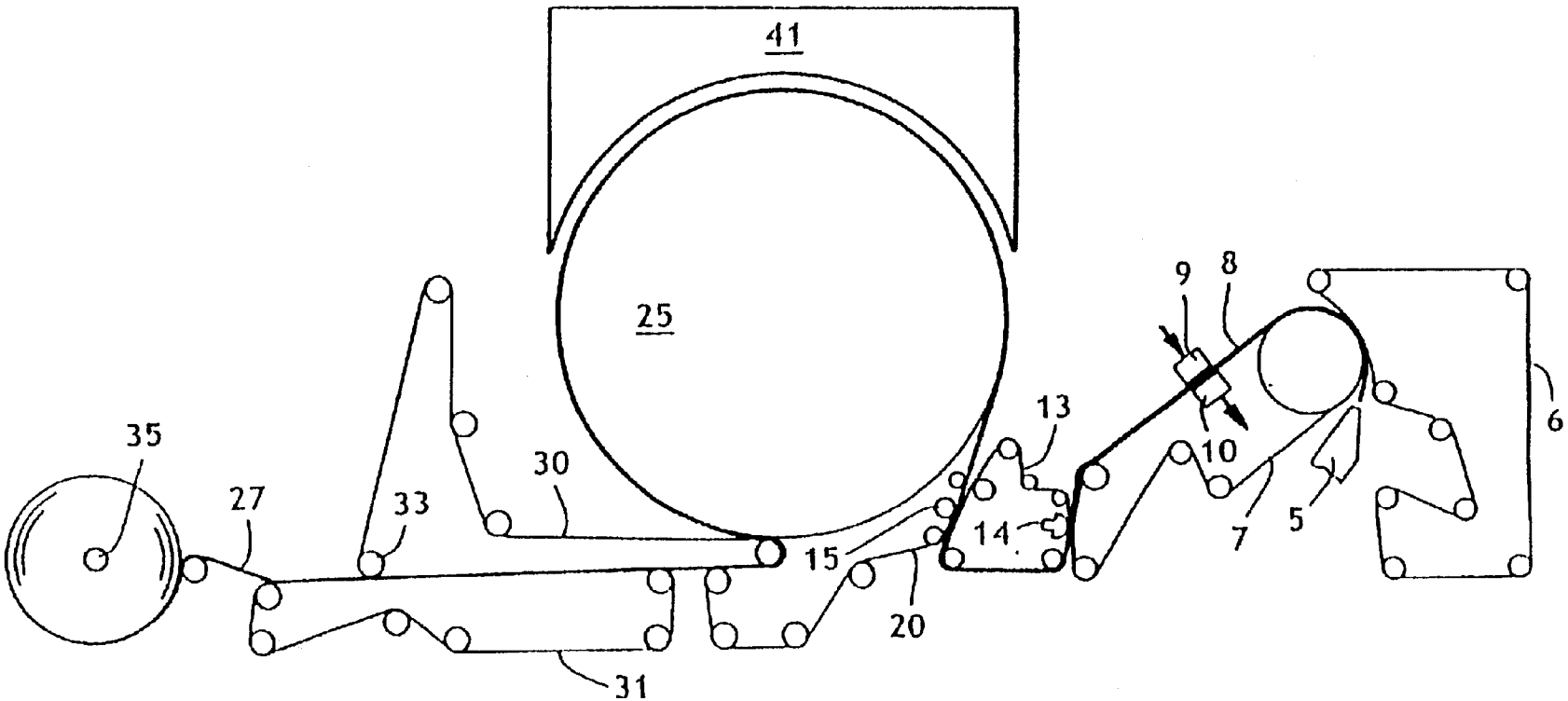
FIG. 1 PRIOR ART
FIG. 1 is a schematic process flow diagram of a prior art uncreped throughdrying process, as disclosed in U.S. Pat. No. 5,672,248.

Referring to the figures, the invention will be described in greater detail. For comparison, FIG. 1 illustrates a prior art throughdrying process. Shown is a twin wire former having a layered papermaking headbox 5 which injects or deposits a stream of an aqueous suspension of papermaking fibers between two forming fabrics 6 and 7. The forming fabric 7 serves to support and carry the newly-formed wet tissue web 8 downstream in the process as the wet tissue web 8 is partially dewatered to a consistency of about 10 to about 35 dry weight percent. Additional dewatering of the wet tissue web 8 may be carried out, such as by vacuum suction, using one or more steam boxes 9 in conjunction with one or more vacuum suction boxes 10 while the wet tissue web 8 is supported by the forming fabric 7. It is understood that the term "tissue web" includes paper webs, including those made from natural and/or synthetic fibers and combinations thereof.

The wet tissue web 8 is then transferred from the forming fabric 7 to a transfer fabric 13 which is traveling at a slower speed than the forming fabric 7 in order to impart increased MD stretch into the wet tissue web 8. Such a transfer is carried out to avoid compression of the wet tissue web 8, preferably with the assistance of a vacuum shoe 14.

The wet tissue web 8 is then transferred from the transfer fabric 13 to the throughdrying fabric 20 with the aid of a vacuum transfer roll 15 or a vacuum transfer shoe. The vacuum assistance ensures deformation of the wet tissue web 8 to conform to the throughdrying fabric 20, thus yielding desired bulk, flexibility, CD stretch, and appearance.

The vacuum transfer roll 15 (negative pressure) may be supplemented or replaced by the use of positive pressure from the opposite side of the wet tissue web 8 to blow the wet tissue web 8 onto the next fabric in addition to or as a replacement for sucking it onto the next fabric with vacuum. Also, a vacuum shoe or shoes may be used to replace the vacuum roll(s).

While supported by the throughdrying fabric 20, the wet tissue web 8 is dried to a final consistency of about 95% or greater by the throughdryer 25 and is thereafter transferred to a carrier fabric 30. The dried tissue web 27 is transported to the reel 35 using carrier fabric 30 and an optional carrier fabric 31. An optional pressurized turning roll 33 can be used to facilitate transfer of the dried tissue web 27 from the carrier fabric 30 to the optional carrier fabric 31. Although not shown, reel calendering or subsequent off-line calendering may be used to improve the smoothness and softness or other properties of the dried tissue web 27.

The hot air used to dry the wet tissue web 8 while passing over the throughdryer 25 is provided by a burner (not shown) and distributed over the surface of the drum of the throughdryer 25 using a hood 41. The air is drawn through the wet tissue web 8 into the interior of the drum of the throughdryer 25 via a fan (not shown) which serves to circulate the air back to the burner.

The TAD system utilizes hot, relatively dry, air to pull bulk water out of the wet tissue web 8. The air also heats the wet tissue web 8 and contributes to the removal of the freezing bound water in the fibers' lamellae. As the second transition is crossed (i.e. including the moisture ratio of between about 0.01 to about 0.03 pound water per pound fiber regime), the energy required to remove the strongly bound non-freezing water is much higher than in the previous moisture regions and the process is much less efficient. In fact, as the moisture content approaches zero, the energy required to remove the remaining water becomes extremely large on a BTU per pound water removed basis. It is in this low-moisture regime where the use of auxiliary dryers is highly beneficial. Such auxiliary dryers may include infrared dryers, microwave dryers, radio frequency dryers, sonic dryers, dielectric dryers, ultraviolet dryers, and combinations thereof. In the present invention, the auxiliary dryer is not a throughdryer, a Yankee dryer, a Yankee dryer and hood combination, or a combination thereof. Using a microwave dryer in this low-moisture regime is ideal as microwave dryers selectively heat the water within the cell wall, thereby vaporizing the water, allowing more rapid removal of the water from the fiber without significantly affecting the cellulose.

Figure 2:
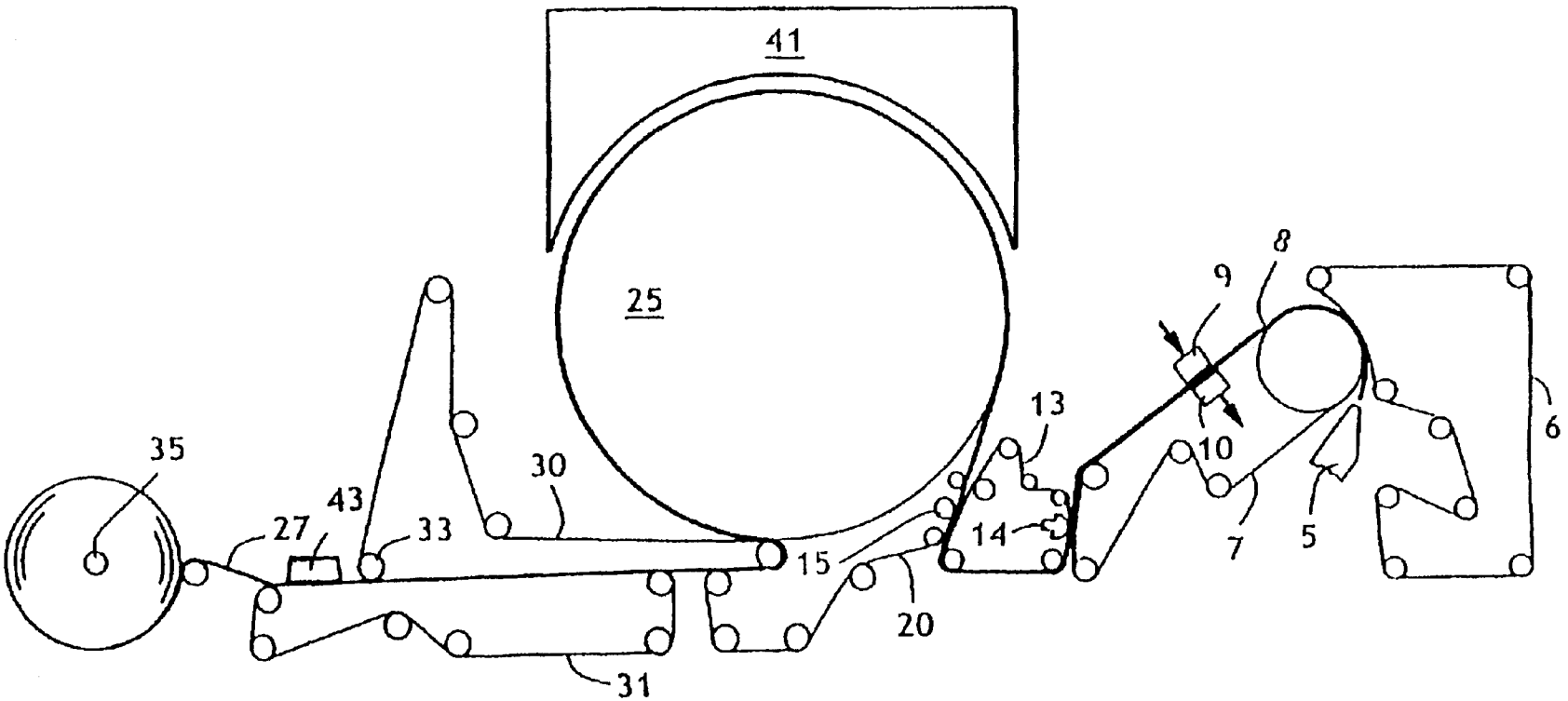
FIG. 2 is a schematic process flow diagram of a throughdrying process in accordance with the present invention, illustrating an uncreped throughdrying process having one throughdryer and an auxiliary dryer following the TAD section.

FIG. 2 is a schematic process flow diagram of a drying process in accordance with the present invention. The configuration of the overall process is shown in FIG. 1 as described above. In addition, shown is the auxiliary dryer 43 which dries the wet tissue web 8 after treatment on the primary dryer 25, in this case, a throughdryer, wherein the wet tissue web 8 is dried to a moisture content of about 5% or less, and more specifically, of about 3% or less.

The auxiliary dryer 43 dries the wet tissue web 8 to a final moisture content of about 5% or less, more specifically about 4% or less, more specifically about 3% or less, and more specifically about 2% or less, and most specifically about 1% or less. In one instance of the present invention, the auxiliary dryer 43 may dry the wet tissue web 8 to a final moisture content between about 5% to about 0%, more specifically between about 4% to about 0%, more specifically between about 3% to about 0.5%, more specifically between about 2% to about 0.5%, and most specifically between about 2% to about 1.5%. In another embodiment of the present invention, the auxiliary dryer 43 may dry the wet tissue web 8 to a final moisture content of between about 5% and about 3%. In another instance of the present invention, the auxiliary dryer 43 may dry the wet tissue web 8 to a final moisture content of between about 3% and about 0%.

Figure 3:
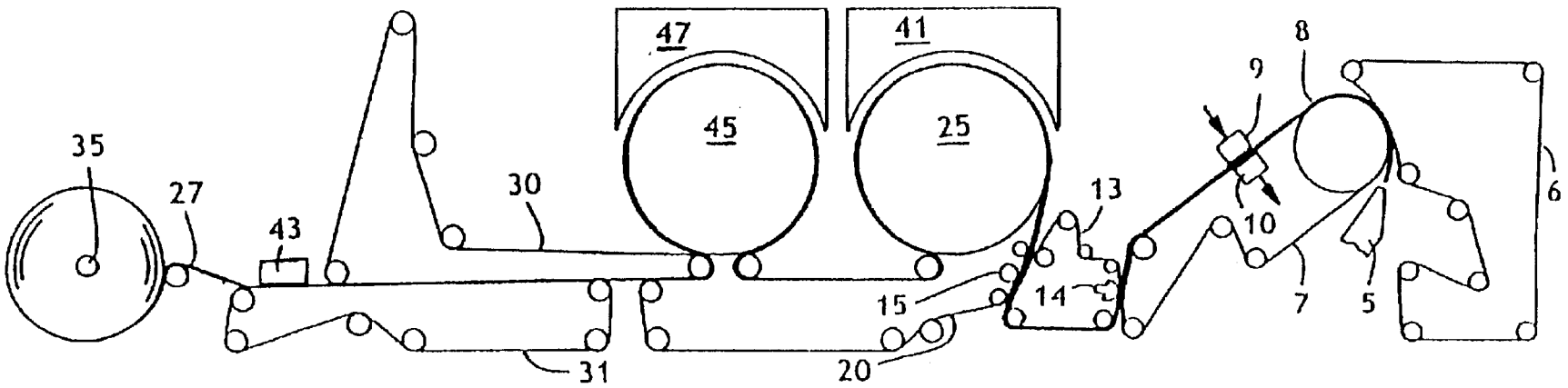
FIG. 3 is a schematic process flow diagram of a throughdrying process in accordance with the present invention, illustrating an uncreped throughdrying process having two throughdryers in series and an auxiliary dryer following the TAD section.

FIG. 3 is a schematic process flow diagram of another drying process in accordance with the present invention, similar to that illustrated in FIG. 2, but in which two primary dryers 25 and 45, such as throughdryers, are used in series to dry the wet web 8. (It is understood that three, four, or more primary dryers may be used in series.) As shown in FIG. 2, the auxiliary dryer 43 is positioned after the final primary dryer 45, wherein the wet tissue web 8 is dried to a final moisture content of about 5% or less and more specifically, of about 3% or less.

The auxiliary dryer 43 dries the wet tissue web 8 to a final moisture content of about 5% or less, more specifically about 4% or less, more specifically of about 3% or less, and most specifically about 2% or less. In one instance of the present invention, the auxiliary dryer 43 may dry the wet tissue web 8 to a final moisture content between about 5% to about 0%, more specifically between about 4% to about 0%, more specifically between about 3% to about 0.5%, more specifically between about 2% to about 0.5%, and most specifically between about 2% to about 1.5%. In another embodiment of the present invention, the auxiliary dryer 43 may dry the wet tissue web 8 to a final moisture content of between about 5% and about 3%. In another instance of the present invention, the auxiliary dryer 43 may dry the wet tissue web 8 to a final moisture content of between about 3% and about 0%.

The efficiency of the primary dryers 25 and 45 is greatly affected by the permeability of the wet tissue web 8 and the fabric 20 on which the wet tissue web 8 is being dried. If there is an area of the wet tissue web 8 that has a lower moisture content than surrounding areas or if there is an area in the wet tissue web 8 containing a hole, such areas of the wet tissue web 8 are preferentially dried as the air seeks the path of least resistance to pass through the wet tissue web 8 into the primary dryers 25 and 45. In addition, using different furnishes will alter the drying properties of the wet tissue web 8 being produced. Hardwood and recycled fibers generally contain more of the smaller particles such as fines and ash, which can decrease the permeability of the wet tissue web 8.

As shown in FIGS. 2 and 3, the auxiliary dryer 43 is positioned after the last of the primary dryers 25 or 45. The wet tissue web 8 has a consistency of between about 95 to about 97 dry weight percent, more specifically between about 95 to about 96 dry weight percent, and most specifically about 95 dry weight percent as the wet tissue web 8 exits the last primary dryer, such as primary dryer 25 in FIG. 2 or the primary dryer 45 in FIG. 3. The wet tissue web 8 has a moisture content after exiting the last primary dryer 25 or 45 of between about 0.05 to about 0.03 pound of water per pound of fiber, more specifically between about 0.05 to about 0.04 pound of water per pound of fiber, and most specifically about 0.05 pound of water per pound of fiber. The CD moisture profile of the wet tissue web 8 may vary +/− about 5 dry weight percent, more specifically +/− about 4 dry weight percent, more specifically +/− about 3 dry weight percent, more specifically +/− about 2 dry weight percent, most specifically +/− about 1 percent. The CD moisture profile of the wet tissue web 8 may vary +/− about 0.03 pound of water per pound of fiber, more specifically about +/−0.02 pound of water per pound of fiber, and most specifically +/− about 0.01 pound of water per pound of fiber.

The auxiliary dryer 43 may also preferentially dry the wet tissue web 8 to a more uniform CD moisture profile. Many factors in the process of drying a wet tissue web 8 can contribute to the variability of the CD moisture profile, which can become quite erratic. Unfortunately, sheet properties of the wet and dried tissue webs 8 and 27 are usually defined by the worst (highest moisture content) portions of the moisture profile. The primary dryers 25 and 45 preferentially dry the already drier areas of the wet tissue web 8 because of the reduced resistance to air flow, which exacerbates the condition, thereby increasing the variability of the moisture profile while overdrying the areas of the wet tissue web 8 that are already dry.

Figure 4:
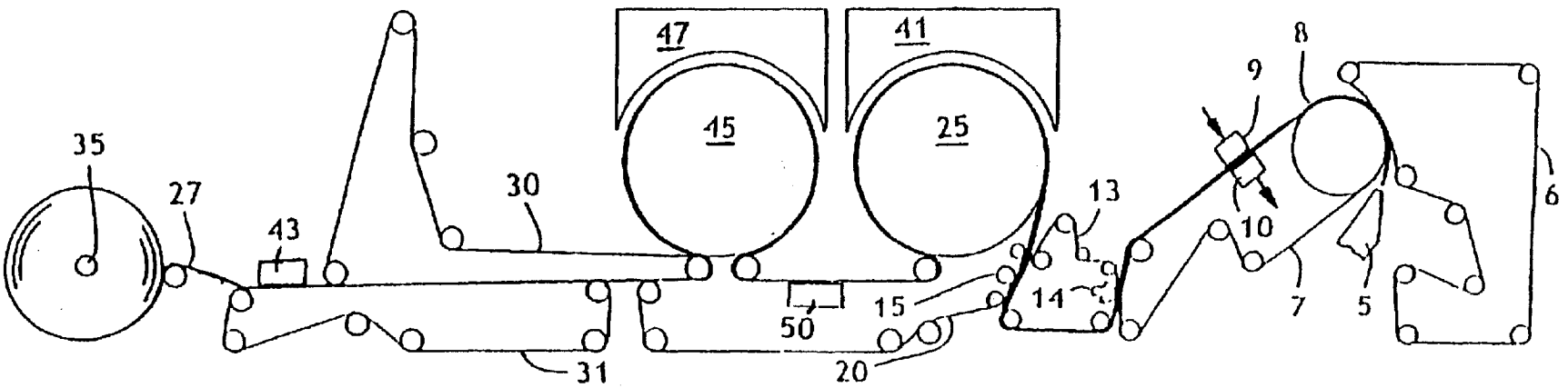
FIG. 4 is a schematic process flow diagram of another throughdrying process in accordance with the present invention, illustrating an uncreped throughdrying process having two throughdryers in series, an auxiliary dryer following the TAD section, and an auxiliary dryer between the throughdryers.
Figure 5:
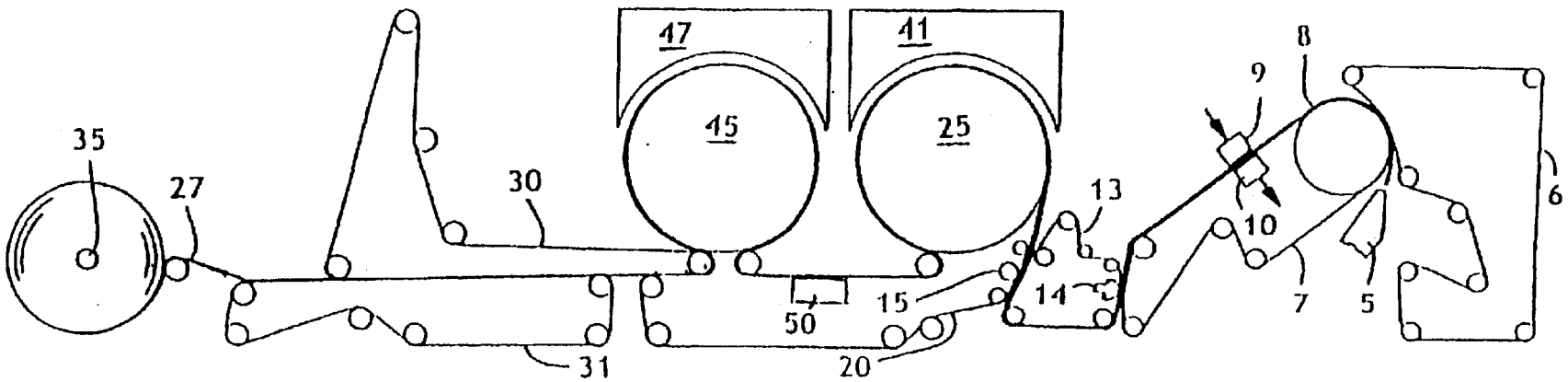
FIG. 5 is a schematic process flow diagram of another throughdrying process in accordance with the present invention, illustrating an uncreped throughdrying process having two throughdryers in series and an auxiliary dryer between the throughdryers.
Figure 6:
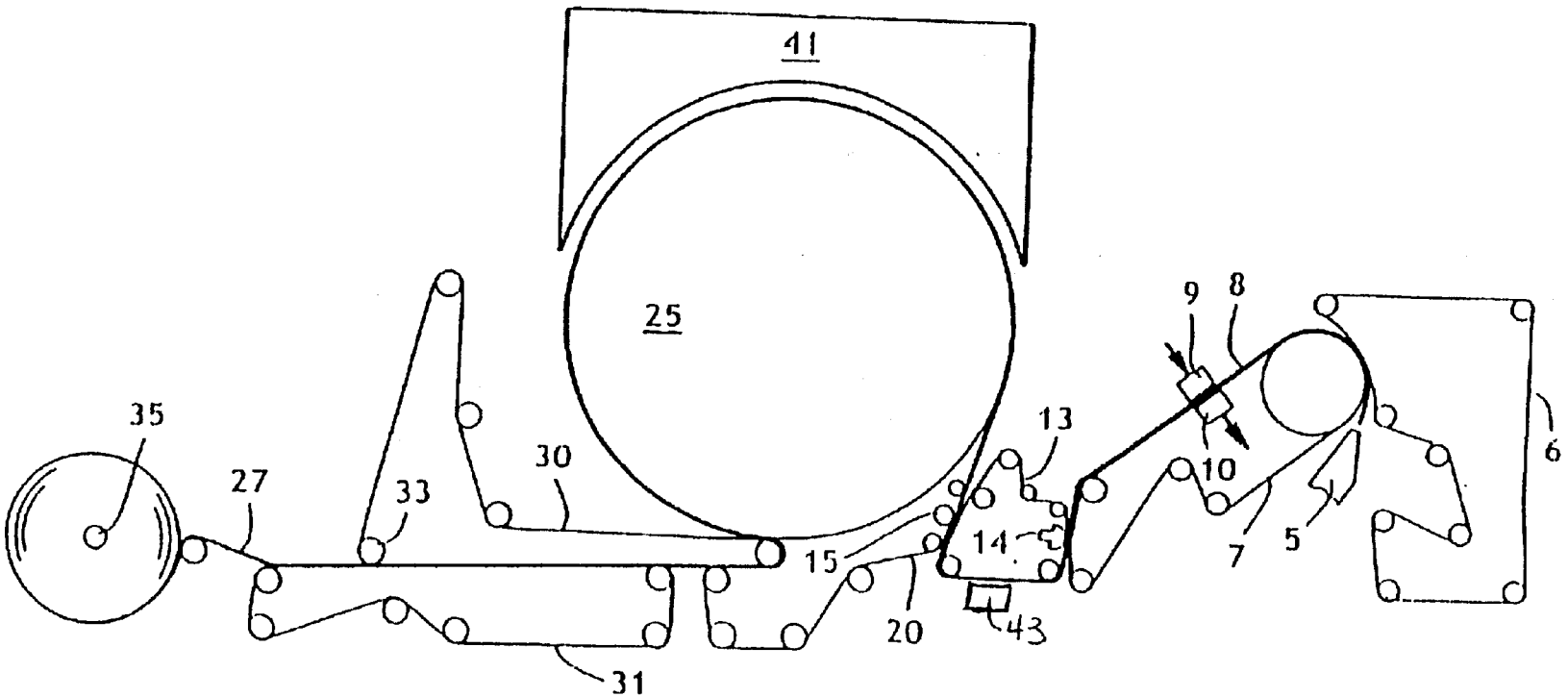
FIG. 6 is a schematic process flow diagram of another throughdrying process in accordance with the present invention, illustrating an uncreped throughdrying process having one throughdryer and an auxiliary dryer positioned before the TAD section.

For this reason, the use of an auxiliary dryer 43 is also beneficial in the more efficient drying of the wet tissue web 8. Because the auxiliary dryer 43 preferentially dries the areas of high moisture, the peaks in a CD moisture profile of the wet tissue web 8 may be "shaved down," effectively reducing the variability in the CD moisture profile. With this reduced variability in the CD moisture profile of the wet tissue web 8, the target, or average operating final moisture can be increased, while keeping the "worst case" moisture the same or even reducing it. This results in improved, more consistent sheet properties of both the wet and dried tissue webs 8 and 27, respectively, as well as decreased overdrying of the wet tissue web 8. In addition to profiling after the last primary dryer 25 or 45, this moisture profile leveling may also be performed between the two primary dryers 25 and 45 of a two primary dryer machine as shown in FIGS. 4 and 5 or before the primary dryer 25 of a one primary dryer machine as shown in FIG. 6 or between any two primary dryers in a machine with more than two primary dryers. Although, an auxiliary dryer could be used in a similar manner before the first primary dryer 25 as shown in FIG. 6 or of a two primary dryer machine.

The wet tissue web 8 has a consistency of about 30 to about 70 dry weight percent, more specifically about 30 to about 66 dry weight percent, more specifically about 33 to about 66 dry weight percent, and most specifically about 40 to about 50 dry weight percent as the wet tissue web 8 enters the primary dryer 45 of FIG. 3 or 4. The wet tissue web 8 has a moisture content before the last primary dryer 45 of between about 0.4 to about 2.5 pounds of water per pound of fiber, more specifically of between about 0.5 to about 2.5 pounds of water per pound of fiber, more specifically between about 0.5 to about 2.0 pounds of water per pound of fiber, and most specifically between about 1.0 to about 1.5 pounds of water per pound of fiber. The CD moisture profile of the wet tissue web 8 may vary +/− about 0.3 pound of water per pound of fiber, more specifically about +/− 0.2 pound of water per pound of fiber, and most specifically +/− about 0.1 pound of water per pound of fiber. After the final auxiliary dryer 43, the CD moisture profile of the dried tissue web 27 may vary +/− about 5 dry weight percent, more specifically +/− about 4 dry weight percent, more specifically +/− about 3 dry weight percent, more specifically +/− about 2 dry weight percent, most specifically +/− about 1 dry weight percent. The CD moisture profile of the dried tissue web 27 after the auxiliary dryer 43 may vary +/− about 0.05 pounds of water per pound of fiber, more specifically about +/−0.04 pound of water per pound of fiber, more +/− about 0.03 pounds of water per pound of fiber, more specifically about +/−0.02 pound of water per pound of fiber, and most specifically +/− about 0.01 pound of water per pound of fiber.

In embodiments of the present invention where a third primary dryer (not shown) is included, the wet tissue web 8 has a consistency equal to or greater than about 50 dry weight percent, more specifically equal to or greater than about 57 dry weight percent, more specifically equal to or greater than about 66 dry weight percent, more specifically equal to or greater than about 70 dry weight percent, more specifically equal to or greater than about 77 dry weight percent, and most specifically equal to or greater than about 80 dry weight percent as the wet tissue web 8 exits the second primary dryer 45 and enters the third primary dryer. The wet tissue web 8 has a moisture content of less than or equal to about 1 pound of water per pound of fiber, more specifically equal to or less than about 0.75 pound of water per pound of fiber, more specifically equal to or less than about 0.5 pound of water per pound of fiber, more specifically equal to or less than about 0.4 pound of water per pound of fiber, more specifically equal to or less than about 0.3 pound of water per pound of fiber, and most specifically equal to or less than about 0.25 pound of water per pound of fiber entering the last (third) primary dryer. The CD moisture profile of the wet tissue web 8 may vary +/− about 0.3 pounds of water per pound of fiber, more specifically about +/−0.2 pound of water per pound of fiber, and most specifically +/− about 0.1 pound of water per pound of fiber. The CD moisture profile of the dried tissue web 27 after the auxiliary dryer 43 may vary +/− about 5 dry weight percent, more specifically +/− about 4 dry weight percent, more specifically +/− about 3 dry weight percent, more specifically +/− about 2 dry weight percent, most specifically +/− about 1 dry weight percent. The CD moisture profile of the dried tissue web 27 after the auxiliary dryer 43 may vary +/− about 0.05 pounds of water per pound of fiber, more specifically about +/−0.04 pound of water per pound of fiber, more +/− about 0.03 pounds of water per pound of fiber, more specifically about +/−0.02 pound of water per pound of fiber, and most specifically +/− about 0.01 pound of water per pound of fiber.

FIG. 4 shows the positioning of a secondary auxiliary dryer 50 between the two primary dryers 25 and 45. Such secondary auxiliary dryers may include infrared dryers, microwave dryers, radio frequency dryers, sonic dryers, dielectric dryers, ultraviolet dryers, and combinations thereof. The secondary auxiliary dryer 50 is an auxiliary dryer positioned between two primary dryers. In the present invention, the secondary auxiliary dryer is not a throughdryer, a Yankee dryer, a Yankee dryer and hood combination, or a combination thereof.

The wet tissue web 8 has consistency of about 30 to about 70 dry weight percent, more specifically about 30 to about 66 dry weight percent, more specifically about 33 to about 60 dry weight percent, and most specifically about 40 to about 50 dry weight percent as the wet tissue web 8 exits the primary dryer 25. The CD moisture profile of the wet tissue web 8 may vary +/− about 0.3 pound of water per pound of fiber, more specifically about +/−0.2 pound of water per pound of fiber, and most specifically +/− about 0.1 pound of water per pound of fiber. However, the CD moisture profile of the dried tissue web 27 after the auxiliary dryer 50 may vary +/− about 5 dry weight percent, more specifically +/− about 4 dry weight percent, more specifically +/− about 3 dry weight percent, more specifically +/− about 2 dry weight percent, most specifically +/− about 1 dry weight percent. It is understood that while a two auxiliary dryer system (an auxiliary dryer and a secondary auxiliary dryer) is shown in FIG. 4, in other embodiments of the present invention, an auxiliary dryer system using a single secondary auxiliary dryer 50 positioned between primary dryers or before the primary dryer in a single primary dryer machine, such as the single TAD machine as shown in FIG. 6, may also be used.

The secondary auxiliary dryer 50 then preferentially dries the wet tissue web 8 to a more uniform CD moisture profile. The auxiliary dryer 43 is positioned after the two primary dryers 25 and 45, thereby achieving a lower final moisture content more efficiently in addition to the advantages gained by the more uniform CD moisture profile that is achieved from secondary auxiliary dryer 50 in the wet tissue web 8.

FIG. 5 shows the positioning of a secondary auxiliary dryer 50 between the two primary dryers 25 and 45. The wet tissue web 8 has a consistency of about 30 to about 70 dry weight percent, more specifically about 30 to about 66 dry weighty percent, more specifically about 33 to about 66 dry weight percent, and most specifically about 40 to about 50 dry weight percent as the wet tissue web 8 exits the primary dryer 25. However, as discussed above, the CD moisture profile of the wet tissue web 8 may be large.

The secondary auxiliary dryer 50 then preferentially dries the wet tissue web 8 to a more uniform CD moisture profile. As discussed above, the more uniform CD moisture profile enables the second primary dryer 45 to achieve a lower final moisture content more efficiently in the dried tissue web 27 than a configuration without an auxiliary dryer 43 positioned after the primary dryers 25 and 45.

The total energy utilization of the process of the present invention uses less than about 10,000 BTU per pound of water, more specifically less than about 9,000 BTU per pound of water, more specifically less than about 8,500 BTU per pound of water, more specifically less than about 8,000 BTU per pound of water, more specifically less than about 7,500 BTU per pound of water, more specifically less than about 7,000 BTU per pound of water, more specifically less than about 6,500 BTU per pound of water, more specifically less than about 6,000 BTU per pound of water, more specifically less than about 5,500 BTU per pound of water, more specifically less than about 5,000 BTU per pound of water, more specifically less than about 4,500 BTU per pound of water, more specifically less than about 4,000 BTU per pound of water, more specifically less than about 3,500 BTU per pound of water, most specifically less than about 3,000 BTU per pound of water from the tissue web between about 5% moisture and a final moisture of about 1%.

The papermaking process of the present invention requires about 80% less energy, more specifically about 85% less energy, more specifically about 90% less energy, more specifically about 92% less energy, more specifically about 95% less energy, and most specifically about 97% less energy than a similar UCTAD papermaking process that does not include an auxiliary dryer for drying in the about 5% to about 1% moisture range.

The characteristics of the tissue products manufactured using the present invention are disclosed in U.S. Pat. No. 5,607,551 issued on Sep. 30, 1997 to Farrington et al., the specification and claims of which are each hereby incorporated herein by reference in their entirety into this specification as if fully set forth herein. The processes for the manufacture of tissue products to which the present invention may be applied, including but not limited to, are disclosed in U.S. Pat. No. 5,607,551 issued on Sep. 30, 1997 to Farrington et al.; U.S. Pat. No. 5,672,248 issued on Sep. 30, 1997 to Wendt et al.; U.S. Pat. No. 5,494,554 issued on Feb. 27, 1996 to Edwards et al.; and, U.S. Pat. No. 4,300,981 issued on Nov. 17, 1981 to Carstens, the specifications and claims of which are each hereby incorporated herein by reference in their entirety into this specification as if fully set forth herein.

EXAMPLES

Example 1

A) Determination of Ambient Sheet Moisture

A 26.6 gsm (gram per square meter) (15.7 lb/2880 $ft^2$) tissue web was made in accordance with the process illustrated in U.S. Pat. No. 5,607,551 using a flat TAD fabric. The tissue web was dried during manufacturing to about 1% moisture and allowed to rehumidify in ambient conditions prior to the microwave drying experiment.

To determine the ambient moisture content of the sheet at the time of the experiment, a sample was dried in an oven and weighed while in the bone-dry state, yielding 7.19 g. The sheet was then allowed to rehumidify for three days to its ambient moisture and was re-weighed while in this air-dry state, resulting in 7.60 g. The difference between the weights of the sheet in the bone-dry state and in the air-dry state, which is the weight of the water removed by drying, was divided by the air-dry weight to determine the ambient moisture content after rehumidification, or $$\frac{7.60\ \text{g} - 7.19\ \text{g}}{7.60\ \text{g}} = 0.054 = 5.4\% \cdot \text{ambientmoisture}.$$

Stated another way, the ambient moisture ratio is reported in pounds of water per pound of fiber and is $$\frac{7.60\ \text{g}\cdot\text{fiber} + \text{water} - 7.19\ \text{g}\cdot\text{fiber}}{7.19\ \text{lb}\cdot\text{fiber}} = \frac{0.057\ \text{lb}\cdot\ \text{water}}{\text{lb}\cdot\text{fiber}}$$

for this control sample.

B) Microwave Drying Experiment

A separate sample of the 66:34 eucalyptus kraft/northern softwood kraft tissue web was dried from its known ambient moisture content of about 5.4% to a final "after-dryer" moisture using a microwave dryer. The sample was dried using a microwave frequency of 2450 MHz at a web speed of 100 feet per minute (fpm) The total power consumed by the microwave dryer was 4.00 kW and the reflected power was 0.87 kW. Hence, the absorbed power was $$4.00\ \text{kW} - 0.67\ \text{kW} =$$

$$3.33\ \text{kW or } \frac{3.33\ \text{kW}}{} \times \frac{\frac{1\ \text{BTU}}{\text{min}}}{0.0176\ \text{kW}} \times \frac{60\ \text{min}}{\text{hr}} = \frac{11{,}352\ \text{BTU}}{\text{hr}}.$$

The sample was then weighed after drying (5.24 g) and again after rehumidification in ambient air (5.43 g). By difference it was determined that 5.43 g−5.24 g=0.19 g.water had been removed from the sample.

The bone dry weight (0% moisture) of the sample was determined by multiplying the rehumidified weight, 5.43 g, by 0.946 which is (1−the previously determined ambient moisture of 0.054). This resulted in a bone dry weight of $$(5.43\ \text{g}\cdot\text{fiber} + \text{water}) \times \left(1 - \frac{0.054\ \text{g}\cdot\text{water}}{\text{g}\cdot\text{fiber} + \text{water}}\right) = 5.14\ \text{g}\cdot\text{fiber}.$$

The water removed, expressed as a percent of the rehumidified weight of the sheet, was the 0.19 g water removed during drying divided by the 5.43 g rehumidified weight, or $$\frac{0.19\ \text{g}\cdot\text{water}}{5.43\,\text{g}\cdot\text{fiber}+\text{water}} = 0.035 = 3.5\%.$$

The final moisture after drying was the ambient moisture of 5.4% minus the percent moisture removed from the sheet during microwave drying, 3.5%, or 5.4%−3.5%=1.9%.

During the experiment, the fiber mass flow rate was calculated by multiplying the basis weight of the sheet by its cross machine direction width and then by the speed at which it was transported through the microwave dryer, so $$\frac{15.7\ \text{lb}\cdot\text{fiber}}{2880\ \text{ft}^2}\times\frac{15\ \text{in}}{\frac{12\ \text{in}}{\text{ft}}}\times\frac{100\ \text{ft}}{\text{min}} = \frac{0.68\ \text{lb}\cdot\text{fiber}}{\text{min}}.$$

The total water removed was then calculated by multiplying the water removed per pound of dry fiber in the after-dryer sample by the mass flow of dry fiber through the microwave dryer $$\frac{0.19\ \text{lb}\cdot\text{water}}{5.14\,\text{lb}\cdot\text{fiber}}\times\frac{0.68\ \text{lb}\cdot\text{fiber}}{\text{min}}\times\frac{60\ \text{min}}{\text{hr}} = \frac{1.51\ \text{lb}\cdot\text{water}}{\text{hr}}.$$

Hence, the total energy utilization of the microwave dryer, per pound water removed, was about $$\frac{11{,}352\ \text{BTU}}{\text{hr}}\times\frac{\text{hr}}{1.51\ \text{lb}\cdot\text{water}} = \frac{7518\ \text{BTU}}{\text{lb}\cdot\text{water}}$$

removed from the sample. When compared to an energy utilization of about 50,000 BTU per pound water removed in a similar process not including the use of an auxiliary dryer, such as the microwave dryer, the process of the present invention used about 15% of the energy requirements of the similar process not including an auxiliary dryer.

Example 1 Data Table—26.6 gsm (18.9 lb/2880 ft$^2$) Flat TAD Fabric Sample

| Speed (fpm) | Power (kW) | Reflected Power (kW) | Net Power (In-Reflected) (kW) | Energy (BTU/hr) | Baggie Weight (g) | Baggie + After-Dryer Samples (g) | Baggie + Rehumidified Sample (g) | After-Dryer Sample† (g) |
|---|---|---|---|---|---|---|---|---|
| | | | | | [A] | [B] | [C] | [D]‡ |
| | | | Determination of Ambient Sheet Moisture: Flat TAD Fabric | | | | | |
| — | — | — | — | — | 2.89 | 10.08 | 10.48 | 7.19 |
| | | | Microwave Drying Experiment: Flat TAD Fabric | | | | | |
| 100 | 4.00 | 0.67 | 3.33 | 11,352 | 5.56 | 10.80 | 10.99 | 5.24 |

| Rehumidified Sample (g) | Water Removed by Drying (g) | Water Removed (% of rehumidified sheet | Bone Dry Sample: 0% moisture (g) | Fiber Mass Flow (lb/hr) | Water Removed (lb/hr) | Final Moisture (%) | Specific Energy Consumed (BTU/lb water) | Energy Consumption (% Reduction vs. Commercial) |
|---|---|---|---|---|---|---|---|---|
| [E] | [F] | [G] | [H] | | | [I] | [J] | [K] |
| | | Determination of Ambient Sheet Moisture: Flat TAD Fabric | | | | | | |
| 7.60 | 0.41 | 5.4 | — | — | — | — | — | — |
| | | Microwave Drying Experiment: Flat TAD Fabric | | | | | | |
| 5.43 | 0.19 | 3.5 | 5.14 | 0.68 | 1.51 | 1.90 | 7,518 | 85 |

†The After-Dryer Sample weight for the control was measured after several days in an oven at 105 ± 5° F. This weight is also the bone dry weight for the sample, as all water is believed to have been removed. The rehumidified sample is actually the ambient sample before drying for

‡[D = B − A]

[E = C − A]

[F = E − D]

[G = F/D]

[H = G * (1-ambient moisture of 0.051)]

[I = $G_{control} - G_{experimental}$]

[K = $J_{experimental}/J_{commercial}$) * 100]

Example 2

A) Determination of Ambient Sheet Moisture

The ambient moisture from Example 1 is again used for Example 2, as the same basesheet was used for both experiments. The two experiments differ in microwave process settings by which the sample was dried. The ambient moisture was 5.4% and the ambient moisture ratio was 0.057 lb water/lb fiber.

B) Microwave Drying Experiment

The process of Example 1 was repeated with a tissue web having the same physical properties as the sample of Example 1. The sample of the 66:34 eucalyptus kraft/northern softwood kraft tissue web was dried from its ambient moisture content of about 5.4% to a final "after-dryer" moisture using the microwave dryer. The sample was dried using a frequency of 2450 MHz at a web speed of 150 feet per minute (fpm.) The total power consumed by the microwave dryer was 4.00 kW and the reflected power was 0.60 kW. Hence, the absorbed power was 4.00 kW−0.60 kW=3.40 kW or $$\frac{3.40\ \text{kW}}{} \times \frac{\frac{1\ \text{BUT}}{\text{min}}}{0.0176\ \text{kW}} \times \frac{60\ \text{min}}{\text{hr}} = \frac{11{,}591\ \text{BUT}}{\text{hr}}.$$

The sample was then weighed after drying (4.21 g) and again after rehumidification in ambient air (4.37 g). By difference it was determined that 4.37 g−4.21 g=0.16 g.water had been removed from the sample.

The bone dry weight (0% moisture) of the sample was determined by multiplying the rehumidified weight, 4.37 g, by 0.946 which is (1−the ambient moisture of 0.054). This resulted in a bone dry weight of $$(4.37\ \text{g}\cdot\text{fiber}+\text{water})\times\left(1-\frac{0.054\ \text{g}\cdot\text{water}}{\text{g}\cdot\text{fiber}+\text{water}}\right)=4.13\ \text{g}\cdot\text{fiber}.$$

The water removed, expressed as a percent of the rehumidified weight of the sheet, was the 0.16 g water removed during drying divided by the 4.37 g rehumidified weight, or $$\frac{0.16\ \text{g}\cdot\text{water}}{4.37\ \text{g}\cdot\text{fiber}+\text{water}}=0.037=3.7\%.$$

The final moisture after drying was the ambient moisture of 5.4% minus the percent moisture removed from the sheet during microwave drying, 3.7%, or 5.4%−3.7% =1.7%.

During the experiment, the fiber mess flow rate was calculated by multiplying the basis weight of the sheet by its cross machine direction width and then by the speed at which it was transported through the microwave dryer, so $$\frac{15.7\ \text{lb}\cdot\text{fiber}}{2880\ \text{ft}^2}\times\frac{15\ \text{in}}{\frac{12\ \text{in}}{\text{ft}}}\times\frac{150\ \text{ft}}{\text{min}}=\frac{1.02\ \text{lb}\cdot\text{fiber}}{\text{min}}.$$

The total water removed was then calculated by multiplying the water removed per pound of dry fiber in the after-dryer sample by the mass flow of dry fiber through the microwave dryer $$\frac{0.16\ \text{lb}\cdot\text{water}}{4.13\ \text{lb}\cdot\text{fiber}}\times\frac{1.02\ \text{lb}\cdot\text{fiber}}{\text{min}}\times\frac{60\ \text{min}}{\text{hr}}=\frac{2.37\ \text{lb}\cdot\text{water}}{\text{hr}}.$$

Hence, the total energy utilization of the microwave dryer, per pound water removed, was about $$\frac{11{,}591\ \text{BTU}}{\text{hr}}\times\frac{\text{hr}}{2.37\ \text{lb}\cdot\text{water}}=\frac{4891\ \text{BTU}}{\text{lb}\cdot\text{water}}$$

removed from the sample. When compared to an energy utilization of about 50,000 BTU per pound water removed in a similar process not including the use of an auxiliary dryer, such as the microwave dryer, the process of the present invention used about 10% of the energy requirements of the similar process not including an auxiliary dryer.

Example 2 Data Table—26.6 gsm (18.9 lb/2880 ft$^2$) Flat TAD Fabric Sample

| Speed (fpm) | Power (kW) | Reflected Power (kW) | Net Power (Inflected) (kW) | Energy (BTU/hr) | Baggie Weight (g) | Baggie + After-Dryer Samples (g) | Baggie + Rehumidified Sample (g) | After-Dryer Sample† (g) |
|---|---|---|---|---|---|---|---|---|
| | | | | | [A] | [B] | [C] | [D]‡ |
| | | | Determination of Ambient Sheet Moisture: Flat TAD Fabric | | | | | |
| — | — | — | — | — | 2.89 | 10.08 | 10.49 | 7.19 |
| | | | Microwave Drying Experiment: Flat TAD Fabric | | | | | |
| 150 | 4.00 | 0.60 | 3.40 | 11,591 | 5.61 | 9.82 | 9.89 | 4.21 |

| Rehumidified Sample (g) | Water Removed by Drying (g) | Water Removed (% of rehumidified sheet | Bone Dry Sample: 0% moisture (g) | Fiber Mass Flow (lb/hr) | Water Removed (lb/hr) | Final Moisture (%) | Specific Energy Consumed (BTU/lb water) | Energy Consumption (% Reduction vs. Commercial) |
|---|---|---|---|---|---|---|---|---|
| [E] | [F] | [G] | [H] | | | [I] | [J] | [K] |
| | | Determination of Ambient Sheet Moisture: Flat TAD Fabric | | | | | | |
| 7.60 | 0.41 | 5.4 | — | — | — | — | — | — |

-continued

| Microwave Drying Experiment: Flat TAD Fabric | | | | | | | | |
|---|---|---|---|---|---|---|---|---|
| 4.37 | 0.16 | 3.7 | 4.14 | 1.02 | 2.36 | 1.70 | 4,891 | 90 |

†The After-Dryer Sample weight for the control was measured after several days in an oven at 105 ± 5° F. This weight is also the bone dry weight for the sample, as all water is believed to have been removed. The rehumidified sample is actually the ambient sample before drying for

‡[D = B − A]

[E = C − A]

[F = E − D]

[G = F/D]

[H = G * (1-ambient moisture of 0.051)]

[I = $G_{control} - G_{experimental}$]

[K = $J_{experimental}/J_{commercial}$) * 100]

Example 3

A) Determination of Ambient Sheet Moisture

A similar experiment was performed on a 46.7 gsm (27.5 lb/2880 $ft^2$) sample of a tissue web produced in accordance with the process illustrated in U.S. Pat. No. 5,607,551 with a different, textured, throughdrying fabric t 1203-1 obtained from Voith Fabrics in Florence, Miss. The tissue web was dried during manufacturing to about 1% moisture and stored wrapped in plastic to minimize rehumidification prior to the microwave drying experiment.

To determine the ambient moisture content of the sheet at the time of the experiment, a sample was dried in an oven and weighed while in the bone-dry state, yielding 13.92 g. The sheet was then allowed to rehumidify for three days to its ambient moisture end was re-weighed while in this air-dry state, resulting in 14.31 g. The difference between the weights of the sheet in the bone-dry state and in the air-dry state, which is the weight of the water removed, was divided by the air-dry weight to determine the ambient moisture content after rehumidification, or $$\frac{14.31\ \text{g} - 13.92\ \text{g}}{14.31\ \text{g}} = 0.027 = 2.7\% \cdot \text{ambient moisture.}$$

Stated another way, the ambient moisture ratio is reported in pounds of water per pound of fiber and is $$\frac{14.31\ \text{g}\cdot\text{fiber} + \text{water} - 13.92\ \text{g}\cdot\text{fiber}}{13.92\ \text{g}\cdot\text{fiber}} = \frac{0.028\ \text{lb}\cdot\text{water}}{\text{lb}\cdot\text{fiber}}$$

for the control for this fabric.

B) Microwave Drying Experiment

The sample of the 66:34 eucalyptus kraft/northern softwood kraft tissue web was dried from its ambient moisture content of about 2.7% to a final "after-dryer" moisture using a microwave dryer. The sample was dried using a frequency of 2450 MHz at a web speed of 250 feet per minute (fpm.) The total power consumed by the microwave dryer was 5.40 kW and the reflected power was 0.22 kW. Hence, the absorbed power was $$5.40\ \text{kW} - 0.22\ \text{kW} =$$

$$5.18\ \text{kW or } \frac{5.18\ \text{kW}}{} \times \frac{\frac{1\ \text{BTU}}{\text{min}}}{0.0176\ \text{kW}} \times \frac{60\ \text{min}}{\text{hr}} = \frac{17{,}659\ \text{BTU}}{\text{hr}}.$$

The sample was then weighed after drying (8.60 g) and again after rehumidification in ambient air (8.75 g). By difference it was determined that 8.75 g−8.60 g=0.15 g.water had been removed from the sample.

The bone dry weight (0% moisture) of the sample was determined by multiplying the rehumidified weight, 8.75 g, by 0.973 which is (1−the ambient moisture of 0.027). This resulted in a bone dry weight of $$(8.75\ \text{g}\cdot\text{fiber} + \text{water}) \times \left(1 - \frac{0.027\ \text{g}\cdot\text{water}}{\text{g}\cdot\text{fiber} + \text{water}}\right) = 8.51\ \text{g}\cdot\text{fiber.}$$

The water removed, expressed as a percent of the rehumidified led weight of the sheet, was the 0.15 g water removed during drying divided by the 8.75 g rehumidified weight, or $$\frac{0.15\ \text{g}\cdot\text{water}}{8.75\ \text{g}\cdot\text{fiber} + \text{water}} = 0.017 = 1.7\%.$$

The final moisture after drying was the ambient moisture of 2.7% minus the percent moisture removed from the sheet during microwave drying, 1.7%, or 2.7%−1.7%=1.0%

During the experiment, the fiber mass flow rate was calculated by multiplying the basis weight of the sheet by its cross machine direction width and then by the speed at which it was transported through the microwave dryer, so $$\frac{27.5\ \text{lb}\cdot\text{fiber}}{2880\ \text{ft}^2} \times \frac{15\ \text{in}}{\frac{12\ \text{in}}{\text{ft}}} \times \frac{250\ \text{ft}}{\text{min}} = \frac{2.98\ \text{lb}\cdot\text{fiber}}{\text{min}}.$$

The total water removed was then calculated by multiplying the water removed per pound of dry fiber in the after-dryer sample by the mass flow of dry fiber through the microwave dryer $$\frac{0.15\ \text{lb}\cdot\text{water}}{8.51\ \text{lb}\cdot\text{fiber}} \times \frac{2.98\ \text{lb}\cdot\text{fiber}}{\text{min}} \times \frac{60\ \text{min}}{\text{hr}} = \frac{3.15\ \text{lb}\cdot\text{water}}{\text{hr}}.$$

Hence, the total energy utilization of the microwave dryer, per pound water removed, was about $$\frac{17{,}659\ \text{BTU}}{\text{hr}} \times \frac{\text{hr}}{3.15\ \text{lb}\cdot\text{water}} = \frac{5606\ \text{BTU}}{\text{lb}\cdot\text{water}}$$

removed from the sample. When compared to an energy utilization of about 50,000 BTU per pound water removed in a similar process not including the use of an auxiliary dryer, such as the microwave dryer, the process of the present invention used about 11% of the energy requirements of the similar process not including an auxiliary dryer.

Example 3 Data Table—46.7 gsm (27.5 lb/2880 $ft^2$) Textured TAD Fabric Sample

| Speed (fpm) | Power (kW) | Reflected Power (kW) | Net Power (In-Reflected) (kW) | Energy (BTU/hr) | Baggie Weight (g) | Baggie + After-Dryer Samples (g) | Baggie + Re-humidified Sample (g) | After-Dryer Sample† (g) |
|---|---|---|---|---|---|---|---|---|
| | | | | | [A] | [B] | [C] | [D]‡ |
| Determination of Ambient Sheet Moisture: Textured TAD Fabric | | | | | | | | |
| — | — | — | — | — | 2.86 | 16.78 | 17.17 | 13.92 |
| Microwave Drying Experiment: Textured TAD Fabric | | | | | | | | |
| 250 | 5.40 | 0.22 | 5.18 | 17,659 | 23.4 | 32.00 | 32.15 | 8.60 |

| Re-humidified Sample (g) | Water Removed by Drying (g) | Water Removed (% of re-humidified sheet | Bone Dry Sample: 0% moisture (g) | Fiber Mass Flow (lb/hr) | Water Removed (lb/hr) | Final Moisture (%) | Specific Energy Consumed (BTU/lb water) | Energy Consumption (% Reduction vs. Commercial) |
|---|---|---|---|---|---|---|---|---|
| [E] | [F] | [G] | [H] | | | [I] | [J] | [K] |
| Determination of Ambient Sheet Moisture: Textured TAD Fabric | | | | | | | | |
| 14.31 | 0.39 | 2.7 | — | — | — | — | — | — |
| Microwave Drying Experiment: Textured TAD Fabric | | | | | | | | |
| 8.75 | 0.15 | 1.7 | 8.51 | 2.98 | 3.15 | 1.0 | 5,606 | 89 |

†The After-Dryer Sample weight for the control was measured after several days in an oven at 105 ± 5° F. This weight is also the bone dry weight for the sample, as all water is believed to have been removed. The rehumidified sample is actually the ambient sample before drying for

‡[D = B − A]

[E = C − A]

[F = E − D]

[G = F/D]

[H = G * (1-ambient moisture of 0.051)]

[I = $G_{control} - G_{experimental}$]

[K = $J_{experimental}/J_{commercial}$) * 100]

Examples 1, 2, & 3

Summary Data Table

| Speed (fpm) | Power (kW) | Reflected Power (kW) | Net Power (In-Reflected) (kW) | Energy (BTU/hr) | Baggie Weight (g) | Baggie + After-Dryer Samples (g) | Baggie + Re-humidified Sample (g) | After-Dryer Sample† (g) |
|---|---|---|---|---|---|---|---|---|
| | | | | | [A] | [B] | [C] | [D]‡ |
| Example 1&2: Flat TAD Fabric Control | | | | | | | | |
| — | — | — | — | — | 2.89 | 10.08 | 10.49 | 7.19 |
| Example 1: Flat TAD Fabric Experimental | | | | | | | | |
| 100 | 4.00 | 0.87 | 3.33 | 11,352 | 5.56 | 10.80 | 10.99 | 5.24 |
| Example 2: Flat TAD Fabric Experimental | | | | | | | | |
| 150 | 4.00 | 0.60 | 3.40 | 11,591 | 5.61 | 9.82 | 9.98 | 4.21 |
| Example 3: Textured TAD Fabric Control | | | | | | | | |
| — | — | — | — | — | 2.88 | 16.78 | 17.17 | 13.92 |
| Example 3: Textured TAD Fabric Experimental | | | | | | | | |
| 250 | 5 40 | 0 22 | 5 18 | 17,659 | 23 4 | 32 00 | 32 15 | 8 60 |

-continued

| Re-humidified Sample (g) | Water Removed by Drying (g) | Water Removed (% of re-humidified sheet | Bone Dry Sample: 0% moisture (g) | Fiber Mass Flow (lb/hr) | Water Removed (lb/hr) | Final Moisture (%) | Specific Energy Consumed (BTU/lb water) | Energy Consumption (% Reduction vs. Commercial) |
|---|---|---|---|---|---|---|---|---|
| [E] | [F] | [G] | [H] | | | [I] | [J] | [K] |
| | | | Example 1&2: Flat TAD Fabric Control | | | | | |
| 7.60 | 0.41 | 5.4 | — | — | | — | — | — |
| | | | Example 1: Flat TAD Fabric Experimental | | | | | |
| 5.43 | 0.19 | 3.5 | 5.14 | 0.68 | 1.51 | 1.90 | 7,518 | 85 |
| | | | Example 2: Flat TAD Fabric Experimental | | | | | |
| 4.37 | 0.16 | 3.7 | 4.13 | 1.02 | 2.36 | 1.70 | 4,911 | 90 |
| | | | Example 3: Textured TAD Fabric Control | | | | | |
| 14.31 | 0.39 | 2.7 | — | — | — | | — | — |
| | | | Example 3: Textured TAD Fabric Experimental | | | | | |
| 8.75 | 0.15 | 1.7 | 8.51 | 2.98 | 3.15 | 1.0 | 5,606 | 89 |

†The After-Dryer Sample weight for the control was measured after several days in an oven at 105 ± 5° F. This weight is also the bone dry weight for the sample, as all water is believed to have been removed. The rehumidified sample is actually the ambient sample before drying for

‡[D = B − A]

[E = C − A]

[F = E − D]

[G = F/D]

[H = G * (1-ambient moisture of 0.051)]

[I = $G_{control} - G_{experimental}$]

[K = $J_{experimental}/J_{commercial}$) * 100]

To provide data for comparison with the microwave drying results, trials were run on an experimental through-dried tissue machine using two 12-foot-diameter through-dryers for drying of the wet tissue web. In these trials, a wet tissue web sheet was first dried to approximately 1% final moisture (control code) using standard through drying technology and process conditions. Then the web moisture was increased by reducing the gas flow to the TADs. Fan conditions were held constant, so that over the TAD air supply temperature range of the experiments, a direct comparison between sheet dryness and energy consumption could be calculated by relating gas flow changes to sheet dryness.

The results of the experiments are shown in the table below. Differences in energy consumption may have occurred for a number of reasons, including the two speeds utilized, as well as the different final moisture contents. As expected, in all cases the average energy consumption (expressed as BTU/pound of water removed) was slightly greater than 1,000 BTU/pound, with values ranging from 1200 to 1700 BTU/pound of water evaporated. These values are typical for throughdrying, since the theoretical minimum energy consumption is roughly 1200 BTU/pound (the latent heat of vaporization for water plus the sensible heat to bring the water to the boiling point). Actual energy consumption is always slightly higher than theoretical due to system inefficiencies and so the data indicates the process was being operated in the normal manner.

Of greater interest was the energy consumption in the low-moisture regime. By running experiments with identical conditions except final moisture, the energy consumed in the low-moisture regime was calculated by subtraction.

As previously stated, the final moisture was varied by varying the gas consumption in the two TADs.

| | Speed (fpm) | Pre-TAD MR | Reel MR | BD BW (#/2880 $ft^2$) | Fiber Flow (#/min) | Reel Water Flow (#/min) | Total Gas Flow (CFM) | Gas Energy (BTU/min) | Elec Energy (BTU/min) | Total Energy (BTU/min) | Avg Total Energy/Water Removed (BTU/#water) | Energy/Water Removed from Given Example to Control Case (E or H) (BTU/#water) |
|---|---|---|---|---|---|---|---|---|---|---|---|---|
| A | 1600 | 2.6 | 0.01 | 19 | 12.8 | 0.2 | 36 | 36,200 | 19,847 | 56,047 | 1,690 | 9,000 |
| B | 1600 | 2.6 | 0.01 | 19 | 12.7 | 0.2 | 27 | 26,800 | 19,847 | 46,647 | 1,411 | 103,000 |
| C | 1600 | 2.7 | 0.02 | 19 | 12.5 | 0.2 | 26 | 25,600 | 19,847 | 45,447 | 1,371 | 115,000 |
| D | 1600 | 2.7 | 0.03 | 19 | 12.5 | 0.4 | 21 | 21,400 | 19,847 | 41,247 | 1,221 | 52,000 |
| E | 1600 | 2.7 | 0.01 | 19 | 12.7 | 0.1 | 37 | 37,100 | 19,847 | 56,947 | 1,671 | base |
| F | 1600 | 2.7 | 0.02 | 19 | 12.7 | 0.2 | 26 | 25,500 | 19,847 | 45,347 | 1,319 | 116,000 |
| G | 2400 | 3.1 | 0.03 | 19 | 19.3 | 0.7 | 53 | 52,600 | 19,847 | 72,447 | 1,223 | 1,250 |
| H | 2400 | 3.0 | 0.04 | 20 | 20.4 | 0.7 | 53 | 52,500 | 19,847 | 72,347 | 1,189 | base |
| I | 2400 | 3.0 | 0.13 | 20 | 19.8 | 2.7 | 42 | 42,100 | 19,847 | 61,947 | 1,080 | 5,200 |

The first set of experiments was run at 2400 fpm TAD speed. Comparing runs "H" and "I", the final moisture was varied from 13% in experiment "I" to 4% in experiment "H". TAD energy (gas) consumption went from 42,100 BTU/minute to 52,500 BTU/minute. This resulted in an incremental energy consumption of 5200 BTU/pound of additional water evaporated as the final moisture content of the web was reduced from 13% to 4%.

$$\text{energy}\cdot\text{consumption}_{13\text{-}4\%} = \frac{\Delta\text{energy}}{\Delta\text{reel}\cdot\text{water}\cdot\text{flow}} = \frac{52{,}500-42{,}100}{2.7-0.7} = \frac{10{,}400}{2.0} = \frac{5{,}200\ \text{BTU}}{\text{pound}\cdot\text{water}}$$

This result, which is similar to the values obtained for the microwave drying experiments, shows that there is little if any value to substituting an auxiliary drying means if the final moisture is greater than 4%. Since the energy consumption is approximately the same for both microwave and throughdrying, there is little incentive to substitute an auxiliary drying means for the normal throughdrying. The additional cost and difficulty of using the auxiliary drying means is not rewarded with a substantial increase in drying efficiency.

However, the situation changes drastically when drying to a substantially lower consistency, such as 1%. Comparison of cases "D" and "E" shows the effect of drying from 3% to 1%. In this case the incremental energy consumption is 52,000 BTU/pound of water evaporated, or roughly 10 times the energy consumed using auxiliary drying, such as microwave drying.

$$\text{energy}\cdot\text{consumption}_{3\text{-}1\%} = \frac{\Delta\text{energy}}{\Delta\text{reel.water.flow}} = \frac{37{,}100-21{,}400}{0.4-0.1} = \frac{15{,}700}{0.3} = \frac{52{,}000\ \text{BTU}}{\text{pound.water}}$$

Additionally, comparison of cases "C" and "E" further illustrates the usefulness of auxiliary drying means in the low moisture regime. In these cases, drying to 2% final moisture is compared to drying to 1% final moisture. The incremental energy consumption in drying from 2% final moisture to 1% final moisture is 115,000 BTU/pound of water. In this case, the energy consumption is approximately 20 times the energy consumption from using an auxiliary drying means such as microwave drying.

$$\text{energy}\cdot\text{consumption}_{2\text{-}1\%} = \frac{\Delta\text{energy}}{\Delta\text{reel}\cdot\text{water}\cdot\text{flow}} = \frac{37{,}100-25{,}600}{0.2-0.1} = \frac{11{,}500}{0.1} = \frac{115{,}000\ \text{BTU}}{\text{pound}\cdot\text{water}}$$

This surprising result clearly Illustrates the usefulness of substituting an auxiliary drying means for throughdrying in the very low moisture regime, i.e. from roughly 5% to 1% moisture. The results of the examples are summarized in the table below, and clearly Illustrate the benefit of the claimed invention when drying to very low moistures, as required by uncreped through-air dried tissue processes.

The following table illustrates these values numerically for three examples of constant pre-TAD consistency for comparison of energy use at higher reel moisture.

| Comparison Between Reel Moistures | BTU/pound water removed |
|---|---|
| 13-4% (I vs. H) | 5,200 |
| 3-1% (D vs. E) | 52,000 |
| 2-1% (C vs. E) | 115,000 |

While many aspects of the trial may have affected the energy consumption of each individual code, including the error associated with the sampling and test methods, the pre-TAD consistency was fixed at approximately 27% and conditions were subsequently maintained to avoid unwanted changes in consistency. Given that, the difference in water flow at the reel should reflect the actual difference between water removed by the drying system in the differing conditions.

It will be appreciated that the foregoing examples and description, given for purposes of illustration, are not to be construed as limiting the scope of this invention, which is defined by the following claims and all equivalents thereto.

We claim:

1. A process for making tissue comprising:

(a) forming a wet tissue web by depositing an aqueous suspension of papermaking fibers onto a forming fabric;

(b) partially dewatering the wet tissue web;

(c) partially drying the wet tissue web in at least one primary dryer wherein the wet tissue web is partially dried to a consistency of at least about 95% in the primary dryer; and, (d) additionally drying the wet tissue web by passing the wet tissue web through at least one auxiliary dryer, wherein the auxiliary dryer dries the wet tissue web to a final moisture content of about 5% or less, thereby forming a dried tissue web.

2. The process of claim 1, wherein at least one primary dryer is selected from the group consisting of: a throughdryer; a Yankee dryer; a Yankee dryer and hood combination; a condebelt apparatus; a high-intensify nip press dryer; and, combinations thereof.

3. The process of claim 1, wherein at least one auxiliary dryer is selected from the group consisting of: a microwave dryer; an infrared dryer; a radio frequency dryer; a sonic dryer; a dielectric dryer; an ultraviolet dryer; and, combinations thereof.

4. The process of claim 1, further comprising winding the dried tissue web into a parent roll.

5. The process of claim 1, wherein there is only one primary dryer.

6. The process of claim 1, wherein the wet tissue web is dried by the auxiliary dryer to a final moisture content of about 2% or less.

7. The process of claim 1, wherein the wet tissue web is dried by the auxiliary dryer to a final moisture content of about 1% or less.

8. The process of claim 1, wherein the average moisture of the dried tissue web ranges between a final moisture content of about 5% to about 0%.

9. The process of claim 1, wherein the average moisture of the dried tissue web ranges between a final moisture content of about 5% to about 1%.

10. The process of claim 1, wherein the average moisture of the dried tissue web ranges between a final moisture content at about 4.5% to about 1.5%.

11. The process of claim 1, wherein the average moisture of the dried tissue web ranges between a final moisture content of about 4% to about 2%.

12. The process of claim 1 or 3, wherein the total power utilization of the auxiliary dryer is less than about 10,000 BTU per pound of water removed.

13. The process of claim 1 or 3, wherein the total power utilization of the auxiliary dryer is less than about 5,000 BTU per pound of water removed.

14. The process of claim 1 or 3, wherein the process requires about 80% less energy to dry a wet tissue web having a moisture content of about 5% to a moisture content of about 1% than a similar process not including an auxiliary dryer.

15. The process of claim 1 or 3, wherein the process requires about 90% less energy to dry wet tissue web having a moisture content of about 5% to a moisture content of about 1% than a similar process not including an auxiliary dryer.

16. The process of claim 1 or 3, wherein CD moisture profile of the dried tissue web is about +/−0.03 pound of water per pound of fiber as the dried tissue web exits the auxiliary dryer.

17. The process of claim 1 or 3, wherein the average moisture of the dried tissue web is between about 0.05 pound of water per pound of fiber and about 0.1 pound of water per pound of fiber as the dried tissue web exits the auxiliary dryer.

18. The process of claim 1, further providing at least one secondary auxiliary dryer wherein at least one secondary auxiliary dryer is selected from the group consisting of a microwave dryer; an infrared dryer; a radio frequency dryer; a sonic dryer; a dielectric dryer; an ultraviolet dryer; and, combinations thereof.

19. The process of claim 18, wherein the total power utilization of the secondary auxiliary dryer is less than about 10,000 BTU per pound of water removed.

20. The process of claim 18, wherein the total power utilization of the secondary auxiliary dryer is less than about 5,000 BTU per pound of water removed.

21. A process for making tissue comprising:

(a) forming a wet tissue web by depositing an aqueous suspension of papermaking fibers onto a forming fabric;

(b) partially dewatering the wet tissue web;

(c) partially drying the wet tissue web in at least two primary dryers wherein the wet tissue web is partially dried to a consistency of at least about 95% in the primary dryers; and, (d) additionally diving the wet tissue web by passing the wet tissue web through at least one auxiliary dryer, wherein the auxiliary dryer dries the wet tissue web to a final moisture content of about 5% or less, thereby forming a dried tissue web.

22. The process of claim 21, further comprising winding the dried tissue web into a parent roll.

23. The process of claim 21, wherein there are two primary dryers in series such that the wet tissue web is partially dried in a first primary dryer and thereafter is further partially dried in a second primary dryer.

24. The process of claim 21, wherein there are two primary dryers in series such that the wet tissue web is partially dried in a first primary dryer and thereafter is further partially dried in a second primary dryer to a consistency of at least about 95%.

25. The process of claim 21, wherein there are three or more primary dryers in series such that the wet tissue web is partially dried to a consistency of at least about 95% upon exiting the last primary dryer.

26. The process of claim 21, 23, 24, or 25, wherein at least one of the primary dryers is selected from the group consisting of: a throughdryer; a Yankee dryer; a Yankee dryer and hood combination; a condebelt apparatus; a high-intensity nip press dryer; and, combinations thereof.

27. The process of claim 21, wherein the wet tissue web is dried by the auxiliary dryer to a final moisture content of about 2% or less.

28. The process of claim 21, wherein the wet tissue web is dried by the auxiliary dryer to a final moisture content of about 1% or less.

29. The process of claim 21, wherein the average moisture of the dried tissue web ranges between a final moisture content of about 5% to about 1%.

30. The process of claim 21, wherein the average moisture of the dried tissue web ranges between a final moisture content of about 4.5% to about 1.5%.

31. The process of claim 21, wherein the average moisture of the dried tissue web ranges between a final moisture content of about 4% to about 2%.

32. The process of claim 21, further comprising providing at least one secondary auxiliary dryer positioned between two primary dryers, wherein the secondary auxiliary dryer additionally partially dries the wet tissue web such that the wet tissue web has a moisture content of between about 0.4 pound of water per pound of fiber to about 2.5 pounds of water per pound of fiber and a CD moisture profile of +/− about 0.3 pound of water per pound of fiber.

33. The process of claim 23, further comprising providing at least one secondary auxiliary dryer positioned between two primary dryers, wherein the secondary auxiliary dryer additionally partially dries the wet tissue web such that the wet tissue web has a moisture content of between about 0.4 pound of water per pound of fiber to about 2.5 pounds of water per pound of fiber and a CD moisture profile of +/− about 0.3 pound of water per pound of fiber.

34. The process of claim 25, further comprising providing at least one secondary auxiliary dryer positioned between the second and the third primary dryers, wherein the secondary auxiliary dryer additionally partially dries the wet tissue web such that the wet tissue web has a moisture content equal to or less than about 1 pound of water per pound of fiber and a CD moisture profile of +/− about 0.3 pound of water per pound of fiber.

35. The process of claim 21, 23, 24, 25, 32, 33, or 34, wherein the total power utilization of the auxiliary dryer is less than about 10,000 BTU per pound of water removed.

36. The process of claim 21, 23, 24, 25, 32, 33, or 34, wherein the total power utilization of the auxiliary dryer is less than about 5,000 BTU per pound of water removed.

37. The process of claim 21, 23, 24, 25, 32, 33, or 34, wherein the process requires about 80% less energy to dry a wet tissue web having a moisture content of about 5% to a moisture content of about 1% than a similar process not including an auxiliary dryer.

38. The process of claim 21, 23, 24, 25, 32, 33, or 34, or wherein the process requires about 90% less energy to dry a wet tissue web having a moisture content of about 5% to a moisture content of about 1% than a similar process not including an auxiliary dryer.

39. The process of claim 21, 23, 24, 25, 32, 33, or 34, wherein CD moisture profile of the dried tissue web is about +/−0.03 pound of water per pound of fiber as the dried tissue web exits the auxiliary dryer.

40. The process of claim 21, 23, 24, 25, 32, 33, or 34, wherein the average moisture of the dried tissue web is between about 0.05 pound of water per pound of fiber and about 0.01 pound of water per pound of fiber as the dried tissue web exits the auxiliary dryer.

41. The process of claim 32, 33, or 34, wherein at least one secondary auxiliary dryer is selected from the group consisting of: a microwave dryer; an infrared dryer; a radio frequency dryer; a sonic dryer; a dielectric dryer; an ultraviolet dryer; and, combinations thereof.

42. The process of claim 32, 33, or 34, wherein the total power utilization of the secondary auxiliary dryer is less than about 10,000 BTU per pound of water removed.

43. The process of claim 32, 33, or 34, wherein the total power utilization of the secondary auxiliary dryer is less than about 5,000 BTU per pound of water removed.

44. The process of claim 21, wherein at least one auxiliary dryer is selected from the group consisting of a microwave dryer; an infrared dryer; a radio frequency dryer; a sonic dryer; a dielectric dryer; an ultraviolet dryer; and, combinations thereof.

45. A process for making tissue comprising:

(a) forming a wet tissue web by depositing an aqueous suspension of papermaking fibers onto a forming fabric;

(b) partially dewatering the wet tissue web;

(c) partially drying the wet tissue web in at least one throughdryer wherein the wet tissue web is partially dried to a consistency of at least about 95% in the throughdryer; and, (d) additionally drying the wet tissue web by passing the wet tissue web through at least one auxiliary dryer, wherein the auxiliary dryer dries the wet tissue web to a final moisture content of about 5% or less, thereby forming a dried tissue web.

46. The process of claim 45, further comprising winding the dried tissue web into a parent roil.

47. The process of claim 45, wherein there is only one throughdryer.

48. The process of claim 45, wherein there are two throughdryers in series such that the wet tissue web is partially dried in a first throughdryer and thereafter is further partially dried in a second throughdryer.

49. The process of claim 45, wherein there are two throughdryers in series such that the wet tissue web is partially dried in a first throughdryer and thereafter is further partially dried in a second throughdryer to a consistency of at least about 95%.

50. The process of claim 45, wherein there are three or more throughdryers in series such that the wet tissue web is partially dried to a consistency of at least about 95% upon exiting the last throughdryer.

51. The process of claim 45, wherein the wet tissue web is dried by the auxiliary dryer to a final moisture content of about 2% or less.

52. The process of claim 45, wherein the wet tissue web is dried by the auxiliary dryer to a final moisture content of about 1% or less.

53. The process of claim 45, wherein the average moisture of the dried tissue web ranges between a final moisture content of about 5% to about 0%.

54. The process of claim 45, wherein the average moisture of the dried tissue web ranges between a final moisture content of about 5% to about 1%.

55. The process of claim 45, wherein the average moisture of the dried tissue web ranges between a final moisture content of about 4.5% to about 1.5%.

56. The process of claim 45, wherein the average moisture of the dried tissue web ranges between a final moisture content of about 4% to about 2%.

57. The process of claim 45, further comprising providing at least one secondary auxiliary dryer positioned between two throughdryers, wherein the secondary auxiliary dryer additionally partially dries the wet tissue web such that the wet tissue web has a moisture content of between about 0.4 pound of water per pound of fiber to about 2.5 pounds of water per pound of fiber and a CD moisture profile of +/− about 0.3 pound of water per pound of fiber.

58. The process of claim 48, further comprising providing at least one secondary auxiliary dryer positioned between two throughdryers, wherein the secondary auxiliary dryer additionally partially dries the wet tissue web such that the wet tissue web has a moisture content of between about 0.4 pound of water per pound of fiber to about 2.5 pounds of water per pound of fiber end a CD moisture profile of +/− about 0.3 pound of water per pound of fiber.

59. The process of claim 50, further comprising providing at least one secondary auxiliary dryer positioned between two throughdryers, wherein the secondary auxiliary dryer additionally partially dries the wet tissue web such that the wet tissue web has a moisture content of between about 0.4 pound of water per pound of fiber to about 2.5 pounds of water per pound of fiber and a CD moisture profile of +/− about 0.3 pound of water per pound of fiber.

60. The process of claim 50, further comprising providing at least one secondary auxiliary dryer positioned between the second and the third throughdryers, wherein the secondary auxiliary dryer additionally partially dries the wet tissue web such that the wet tissue web has a moisture content equal to or less than about 1 pound of water per pound of fiber and a CD moisture profile of +/− about 0.3 pound of water per pound of fiber.

61. The process of claim 45, 48, 49, 50, 57, 58, 59, or 60, wherein the total power utilization of the auxiliary dryer is less than about 10,000 BTU per pound of water removed.

62. The process of claim 45, 48, 49, 50, 57, 58, 59, or 60, wherein the total power utilization of the auxiliary dryer is less than about 5,000 BTU per pound of water removed.

63. The process of claim 45, 48, 49, 50, 57, 58, 59, or 60, wherein the process requires about 80% less energy to dry a wet tissue web having a moisture content of about 5% to a moisture content of about 1% than a similar process not including an auxiliary dryer.

64. The process of claim 45, 48, 49, 50, 57, 58, 59, or 60, wherein the process requires about 90% less energy to dry a wet tissue web having a moisture content of about 5% to a moisture content of about 1% than a similar process not including an auxiliary dryer.

65. The process of claim 45, 48, 49, 50, 57, 58, 59, or 60, wherein CD moisture profile of the dried tissue web is about +/−0.03 pound of water per pound of fiber as the dried tissue web exits the auxiliary dryer.

66. The process of claim 45, 48, 49, 50, 57, 58, 59, or 60, wherein the average moisture of the dried tissue web is between about 0.05 pound of water per pound of fiber and about 0.01 pound of water per pound of fiber as the dried tissue web exits the auxiliary dryer.

67. The process of claim 57, 58, 59, or 60, wherein the secondary auxiliary dryer is selected from the group consisting air: a microwave dryer; an infrared dryer; a radio frequency dryer; a sonic dryer; a dielectric dryer; an ultraviolet dryer; and, combinations thereof.

68. The process of claim 57, 58, 59, or 60, wherein the total power utilization of the secondary auxiliary dryer is less than about 10,000 BTU per pound of water removed.

69. The process of claim, 57, 58, 59, or 60, wherein the total power utilization of the secondary auxiliary dryer is less than about 5,000 BTU per pound of water removed.

70. The process of claim 45, wherein the auxiliary dryer is selected from the group consisting at a microwave dryer; an infrared dryer; a radio frequency dryer; a sonic dryer; a dielectric dryer; an ultraviolet dryer; and, combinations thereof.

71. A process for making tissue comprising:

(a) forming a wet tissue web by depositing an aqueous suspension of papermaking fibers onto a forming fabric;

(b) partially dewatering the wet tissue web;

(c) partially drying the wet tissue web in at least two primary dryers wherein the wet tissue web is partially dried to a consistency of at least about 95% in the primary dryers; and (d) additionally drying the wet tissue web by passing the wet tissue web through at least one secondary auxiliary dryer, wherein the secondary auxiliary dryer positioned between the two primary dryers additionally partially dries the wet tissue web such that the wet tissue web has a moisture content of between about 0.4 pound of water per pound of fiber to about 2.5 pounds of water per pound of fiber and a CD moisture profile of +/− about 0.3 pound of water per pound of fiber.

72. The process of claim 71, further comprising winding the dried tissue web into a parent roll.

73. The process of claim 71, further comprising providing at least one auxiliary dryer, wherein the auxiliary dryer dries the wet tissue web to a final moisture content of about 5% or less, thereby forming a dried tissue web.

74. The process of claim 71, wherein there are two primary dryers in series such that the wet tissue web is partially dried in a first primary dryer and thereafter is further partially dried in a second primary dryer.

75. The process of claim 71, wherein there are two primary dryers in series such that the wet tissue web is partially dried in a first primary dryer and thereafter is further partially dried in a second primary dryer to a consistency of at least about 95%.

76. The process of claim 71, wherein there are three or more primary dryers in series such that the wet tissue web is partially dried to a consistency of at least about 95% upon exiting the last primary dryer.

77. The process of claim 71, 74, 75, or 76, wherein at least one of the primary dryers is selected from the group consisting of: a throughdryer; a Yankee dryer; a Yankee dryer and hood combination; a condebelt apparatus; a high-intensity nip press dryer; and, combinations thereof.

78. The process of claim 73, wherein the wet tissue web is dried by the auxiliary dryer to a final moisture content of about 2% or less.

79. The process of claim 73, wherein the wet tissue web is dried by the auxiliary dryer to a final moisture content of about 1% or less.

80. The process of claim 73, wherein the average moisture of the dried tissue web ranges between a final moisture content of about 5% to about 1%.

81. The process of claim 73, wherein the average moisture of the dried tissue web ranges between a final moisture content of about 4.5% to about 1.5%.

82. The process of claim 73, wherein the average moisture at the dried tissue web ranges between a final moisture content of about 4% to about 2%.

83. The process of claim 73, further comprising providing a secondary auxiliary dryer positioned between the second and the third primary dryers wherein the second auxiliary dryer additionally partially dues the wet tissue web such that the wet tissue web has a moisture content equal to or less than about 1 pound of water per pound of fiber and a CD moisture profile of +/− about 0.3 pound of water per pound of fiber.

84. The process of claim 73, 74, 75, 76, or 83, wherein the total power utilization of the auxiliary dryer is less then about 10,000 BTU per pound of water removed.

85. The process of claim 73, 74, 75, 76, or 83, wherein the total power utilization of the auxiliary dryer is less then about 5,000 BTU per pound of water removed.

86. The process of claim 73, 74, 75, 76, or 83, wherein the process requires about 80% less energy to dry a wet tissue web having a moisture content of about 5% to a moisture content of about 1% than a similar process not including an auxiliary dryer.

87. The process of claim 73, 74, 75, 76, or 83, wherein the process requires about 90% less energy to dry a wet tissue web having a moisture content of about 5% to a moisture content of about 1% than a similar process not including an auxiliary dryer.

88. The process of claim 73, 74, 75, 76, or 83, wherein CD moisture profile of the dried tissue web is about +/−0.03 pound of water per pound of fiber as the dried tissue web exits the auxiliary dryer.

89. The process of claim 73, 74, 75, 76, or 83, wherein the average moisture of the dried tissue web is between about 0.05 pound of water per pound of fiber and about 0.01 pound of water per pound of fiber as the dried tissue web exits the auxiliary dryer.

90. The process of claim 71 or 83, wherein at least one secondary auxiliary dryer is selected from the group consisting of: a microwave dryer; an infrared dryer; a radio frequency dryer; a sonic dryer; a dielectric dryer; an ultraviolet dryer; and, combinations thereof.

91. The process of claim 71 or 83, wherein the total power utilization of the secondary auxiliary dryer is less than about 10,000 BTU per pound of water removed.

92. The process of claim 71 or 83, wherein the total power utilization of the secondary auxiliary dryer is less than about 5,000 BTU per pound of water removed.

93. The process of claim 73, wherein at least one auxiliary dryer is selected from the group consisting of: a microwave dryer; an infrared dryer; a radio frequency dryer; a sonic dryer; a dielectric dryer; an ultraviolet dryer; and, combinations thereof.

94. A process for making tissue comprising:

(a) forming a wet tissue web by depositing an aqueous suspension of papermaking fibers onto a forming fabric;

(b) partially dewatering the wet tissue web;

(c) partially drying the wet tissue web in at least one primary dryer to a consistency of at least about 95%; and, (d) additionally drying the wet tissue web by passing the wet tissue web through at least one auxiliary dryer, wherein the auxiliary dryer dries the wet tissue web to a final moisture content of about 5% or less, thereby forming a dried tissue web.

95. A process for making tissue comprising:

(a) forming a wet tissue web by depositing an aqueous suspension of papermaking fibers onto a forming fabric;

(b) partially dewatering the wet tissue web;

(c) partially drying the wet tissue web in at least one throughdryer to a consistency of at least about 95%; and (d) additionally drying the wet tissue web by passing the wet tissue web through at least one auxiliary dryer, wherein the auxiliary dryer dries the wet tissue web to a final moisture content of about 5% or less, thereby fawning a dried tissue web.

* * * * *